US009738955B2

(12) United States Patent
Lee et al.

(10) Patent No.: US 9,738,955 B2
(45) Date of Patent: Aug. 22, 2017

(54) ALUMINUM ALLOY

(71) Applicant: HYUNDAI MOTOR COMPANY, Seoul (KR)

(72) Inventors: Kyung Moon Lee, Uiwang-si (KR); Byung Ho Min, Suwon-si (KR); Hoo Dam Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/664,217

(22) Filed: Mar. 20, 2015

(65) Prior Publication Data

US 2016/0153074 A1 Jun. 2, 2016

(30) Foreign Application Priority Data

Dec. 2, 2014 (KR) ..... 10-2014-0170800

(51) Int. Cl.

| | |
|---|---|
| ***C22C 21/02*** | (2006.01) |
| ***C22C 21/00*** | (2006.01) |
| ***C22C 21/06*** | (2006.01) |
| ***C22C 21/10*** | (2006.01) |
| ***C22C 21/16*** | (2006.01) |
| ***C22C 21/18*** | (2006.01) |

(52) U.S. Cl.

CPC ..... *C22C 21/00* (2013.01); *C22C 21/02* (2013.01); *C22C 21/06* (2013.01); *C22C 21/10* (2013.01); *C22C 21/16* (2013.01); *C22C 21/18* (2013.01)

(58) Field of Classification Search

CPC ..... C22C 21/00; C22C 21/02; C22C 21/06; C22C 21/10; C22C 21/16; C22C 21/18

USPC ..... 148/417

See application file for complete search history.

(56) References Cited

U.S. PATENT DOCUMENTS

2008/0060723 A1* 3/2008 Doty ..... C22C 1/06 148/549

2012/0000578 A1* 1/2012 Wang ..... C22C 21/02 148/549

FOREIGN PATENT DOCUMENTS

| | | | |
|---|---|---|---|
| JP | 2000-008132 | A | 1/2000 |
| JP | 2001-254135 | A | 9/2001 |
| JP | 2001-316748 | A | 11/2001 |
| JP | 2005-264301 | A | 9/2005 |
| JP | 2012-126959 | A | 7/2012 |
| KR | 81-002049 | B1 | 12/1981 |
| KR | 10-2014-0025042 | A | 3/2014 |
| KR | 10-2014-0034557 | A | 3/2014 |
| KR | 10-1418773 | B1 | 7/2014 |

OTHER PUBLICATIONS

Korean Office Action issued in Korean Application No. 10-2014-0170800 dated Aug. 18, 2015.

* cited by examiner

*Primary Examiner* — Roy King
*Assistant Examiner* — Janelle Morillo
(74) *Attorney, Agent, or Firm* — McDermott Will & Emery LLP

(57) ABSTRACT

An aluminum alloy has a low thermal conductivity at room temperature (25° C.) and a high thermal conductivity at high temperature (200° C.). The aluminum alloy includes 1~2 wt % of magnesium (Mg), 1~2 wt % of copper (Cu), 1~2 wt % of zinc (Zn), 0.5~2 wt % of nickel (Ni), and the remainder of aluminum (Al) and inevitable impurities.

2 Claims, 3 Drawing Sheets

Fig. 5
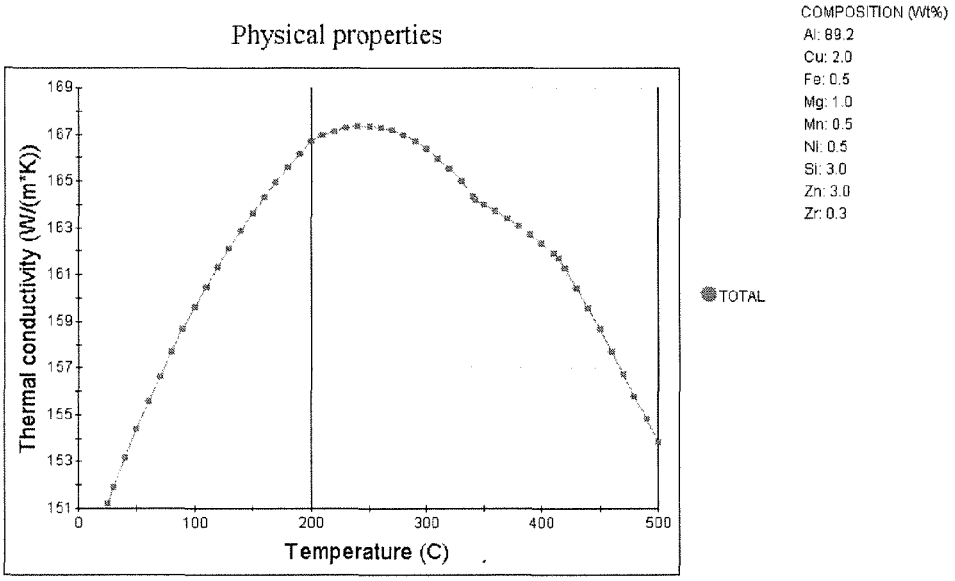
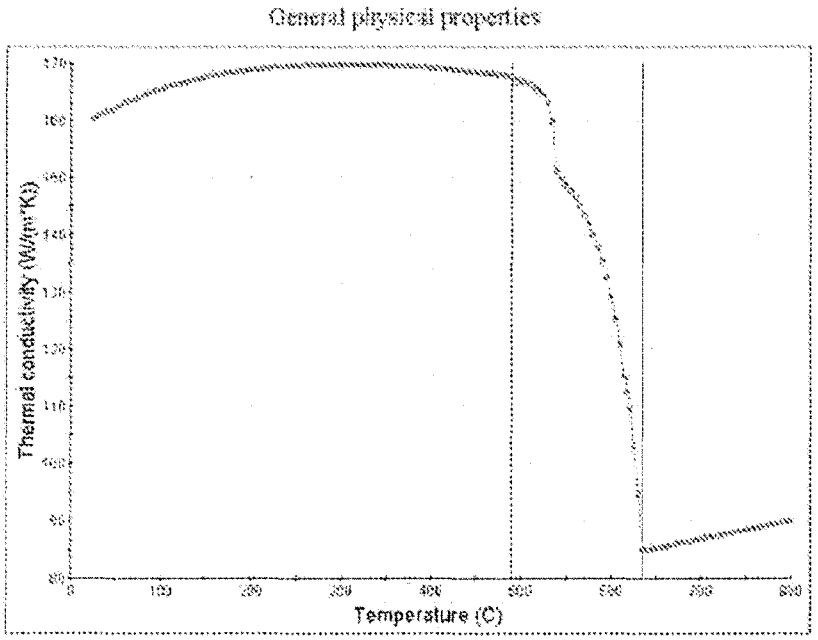
Fig. 6

ALUMINUM ALLOY

CROSS REFERENCE TO RELATED APPLICATION

This application claims priority to Korean Patent Application No. 10-2014-0170800, filed Dec. 2, 2014 in the Korean Intellectual Property Office, the disclosure of which is incorporated herein in its entirety by reference.

BACKGROUND OF THE INVENTION

1. Field of the Invention

The present invention relates to an aluminum alloy and, more particularly, to an aluminum alloy in which changes in thermal conductivity depending on temperature are improved.

2. Description of the Related Art

Typically, engines are capable of exhibiting maximum performance when maintaining a predetermined temperature or higher. Thus, engine parts should possess low thermal conductivity so as to prevent internal heat of a combustion chamber from being emitted to the outside under the low temperature conditions immediately after starting the engine. Furthermore, high thermal conductivity is required to prevent overheating of the combustion chamber under the high temperature conditions at which the temperature of the combustion chamber is elevated after a predetermined period of time following starting the engine.

When the temperature of the combustion chamber is elevated to a predetermined level or higher, problems such as knocking, overheating and adhesion may occur. With the goal of overcoming such problems, it is required that heat dissipation performance, namely, thermal conductivity is superior.

Since a conventional aluminum alloy for use in engine cylinder heads has high thermal conductivity at room temperature and low thermal conductivity at high temperature, engine efficiency may be reduced, undesirably deteriorating fuel efficiency.

FIG. 1 is a graph illustrating thermal conductivity, depending on the temperature, of a conventional AC2B gravity cast aluminum alloy thermally treated under T7 conditions. A typical AC2B alloy is composed of 2~4 wt % of copper (Cu), 5~7 wt % of silicon (Si), 0.5 wt % or less of magnesium (Mg), 1 wt % or less of zinc (Zn), 0.8 wt % or less of iron (Fe), 0.50 wt % or less of manganese (Mn), 0.35 wt % or less of nickel (Ni), 0.20 wt % or less of titanium (Ti), 0.20 wt % or less of lead (Pb), 0.10 wt % or less of tin (Sn), 0.20 wt % or less of chromium (Cr), and the remainder of aluminum (Al).

As illustrated in FIG. 1, an AC2B aluminum alloy has a thermal conductivity of 185 W/m*K or more at room temperature (25° C.) and a thermal conductivity of 185 W/m*K or less at high temperature (200° C.). The AC2B alloy in which thermal conductivity decreases in proportion to an increase in the temperature is undesirable in terms of preheating at room temperature and also in terms of heat dissipation at high temperature. Hence, there is a need for a novel aluminum alloy having low thermal conductivity at room temperature and high thermal conductivity at high temperature.

SUMMARY OF THE INVENTION

Accordingly, the present invention has been made keeping in mind the above problems encountered in the related art, and an object of the present invention is to provide an aluminum alloy having low thermal conductivity at low temperature and high thermal conductivity at high temperature.

In order to accomplish the above object, an aluminum alloy according to an embodiment of the present invention exhibits low thermal conductivity at room temperature (25° C.) and high thermal conductivity at high temperature (200° C.), and comprises: 1~2 wt % of Mg, 1~2 wt % of Cu, 1~2 wt % of Zn, 0.5~2 wt % of Ni, and the remainder of Al and inevitable impurities.

The aluminum alloy may have a thermal conductivity of 185 W/m*k or less at room temperature (25° C.) and a thermal conductivity of 185 W/m*k or more at high temperature (200° C.)

The aluminum alloy may be used for an engine cylinder head.

An aluminum alloy according to another embodiment of the present invention may include magnesium (Mg), copper (Cu), zinc (Zn), nickel (Ni), and aluminum (Al). A thermal conductivity of the aluminum alloy may gradually increase from a room temperature of 25° C. to a high temperature of about 200° C.

The aluminum alloy may have a thermal conductivity of 185 W/m*k or less at the room temperature of 25° C. and a thermal conductivity of 185 W/m*k or more at the high temperature of about 200° C.

Magnesium (Mg) may be 1~2 wt % of the aluminum alloy, copper (Cu) may be 1~2 wt % of the aluminum alloy, zinc (Zn) may be 1~2 wt % of the aluminum alloy, and nickel (Ni) may be 0.5~2 wt % of the aluminum alloy.

According to the present invention, an aluminum alloy can manifest the following effects.

First, engine parts can be rapidly preheated immediately after starting the engine.

Second, efficient cooling becomes possible because of high thermal conductivity at high temperature.

BRIEF DESCRIPTION OF THE DRAWINGS

The above and other objects, features and advantages of the present invention will be more clearly understood from the following detailed description taken in conjunction with the accompanying drawing, in which:

FIG. 5 is a graph illustrating a decrease in thermal conductivity at high temperature due to the addition of Zn in an excessive amount (3 wt %); and FIG. 6 is a graph illustrating a decrease in thermal conductivity at high temperature due to the addition of Ni in an excessive amount (2.5 wt %).

DESCRIPTION OF SPECIFIC EMBODIMENTS

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, a detailed description will be given of an Al alloy according to preferred embodiments of the present invention with reference to the appended drawings.

Figure 1:
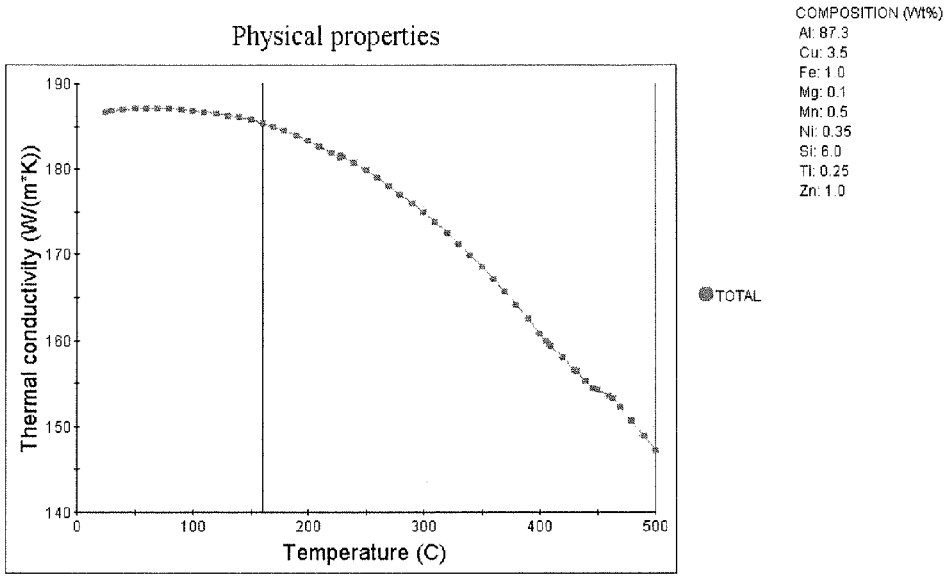
FIG. 1 is a graph illustrating thermal conductivity of a conventional AC2B T7 aluminum alloy depending on the temperature.
Figure 2:
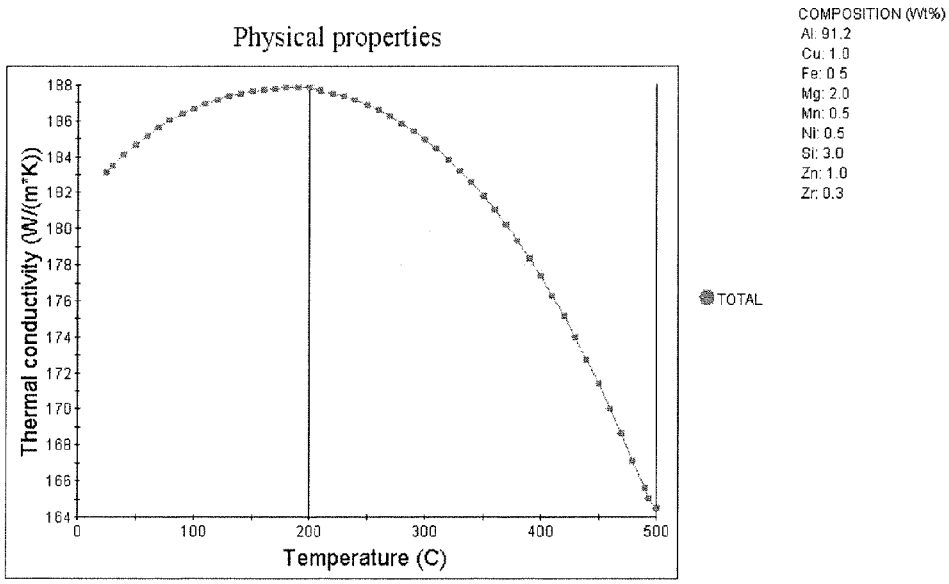
FIG. 2 is a graph illustrating thermal conductivity of an aluminum alloy according to an embodiment of the present invention depending on the temperature.

As illustrated in FIG. 2, an Al alloy having low thermal conductivity at room temperature and high thermal conductivity at high temperature has to contain 1~2 wt % of Mg, 1~2 wt % of Cu, 1~2 wt % of Zn, 0.5~2 wt % of Ni, and the remainder of Al and inevitable impurities. The inevitable impurities may include at least one of silicon (Si), iron (Fe), manganese (Mn), titanium (Ti), lead (Pb), tin (Sn), chromium (Cr), and zirconium (Zr).

Solubility and resistivity of alloy elements for Al are summarized in Table 1 below. As such, Cu, Mg, Ni and Zn have low solubility. When elements having low solubility in an Al matrix are used in this way, intermetallic compounds resulting from reaction with different alloy elements may be maximized, and thereby desired properties may be obtained.

Figure 3:
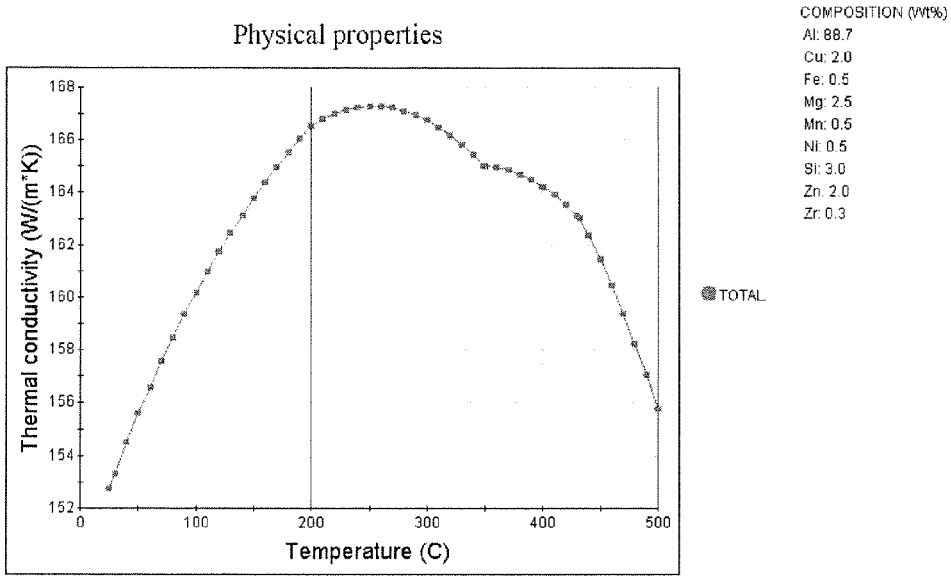
FIG. 3 is a graph illustrating a decrease in thermal conductivity at high temperature due to the addition of Mg in an excessive amount (2.5 wt %)

Mg plays a role in decreasing thermal conductivity at room temperature (25° C.), and has to be added in a relatively large amount compared to a conventional AC2B Al alloy, in order to reduce thermal conductivity at room temperature. The reason why thermal conductivity at room temperature is reduced by Mg is that resistivity of Mg solid-solved in an Al matrix is high. Hence, Mg is added in an amount of at least 1 wt %. If the amount of Mg exceeds 2 wt %, thermal conductivity at high temperature (200° C.) may decrease. Hence, the upper limit of the amount of Mg is set to 2 wt %. As illustrated in FIGS. 2 and 3, thermal conductivity at high temperature (200° C.) may be decreased when Mg is added in an amount of 2.5 wt %.

Zn has low atomic scattering resistance in an Al matrix. Accordingly, Zn in solid-solution state has a low increment in resistivity depending on the increase in temperature, compared to other elements, and is thus effective at increasing thermal conductivity at high temperature (200° C.). Also, since Zn has high solubility in Al, it may be easily deposited upon thermal treatment, thereby enhancing mechanical strength. To attain such effects, Zn is added in an amount of 1 wt % or more. If the amount of Zn exceeds 2 wt %, thermal conductivity at high temperature (200° C.) may decrease. Hence, the upper limit of the amount of Zn is set to 2 wt %. As illustrated in FIGS. 2 and 5, when 3 wt % of Zn is added, thermal conductivity at high temperature (200° C.) is decreased.

Figure 4:
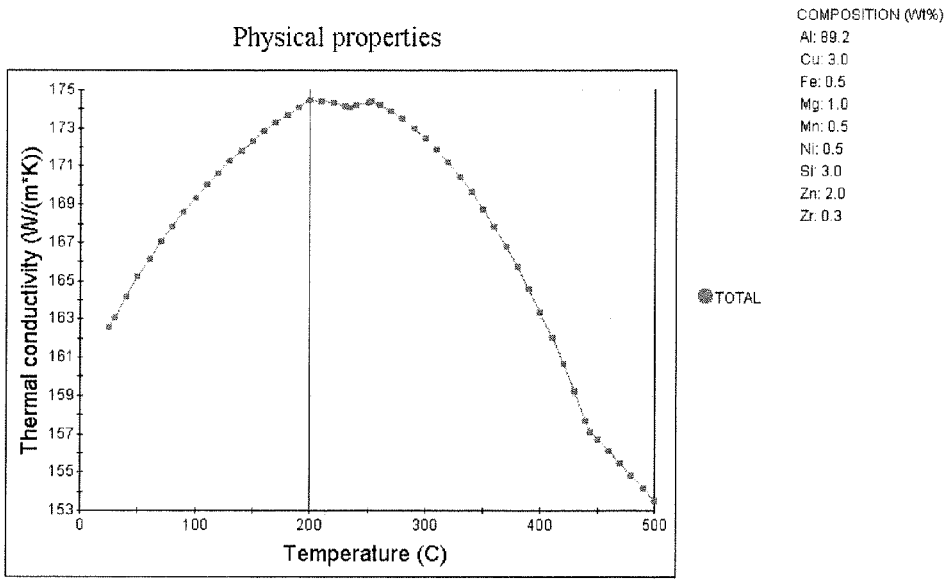
FIG. 4 is a graph illustrating a decrease in thermal conductivity at high temperature due to the addition of Cu in an excessive amount (3 wt %)

Cu is added in an amount of 1 wt % or more to ensure the strength of an alloy. If the amount of Cu exceeds 2 wt %, thermal conductivity at high temperature (200° C.) may decrease. Hence, Cu is used in an amount of 2 wt % or less. As illustrated in FIGS. 2 and 4, thermal conductivity at high temperature (200° C.) is decreased when 3 wt % of Cu is added.

Ni is added in an amount of 0.5 wt % or more to ensure castability. If the amount of Ni exceeds 2 wt %, thermal conductivity at high temperature (200° C.) may decrease. Hence, Ni is used in an amount of 2 wt % or less. As illustrated in FIGS. 2 and 6, thermal conductivity at high temperature (200° C.) is decreased when 2.5 wt % of Ni is added.

The Al alloy according to the present invention has a thermal conductivity of 185 W/m*k or less at room temperature (25° C.) and a thermal conductivity of 185 W/m*k or more at high temperature (200° C.), and is preferably utilized for an engine cylinder head.

TABLE 1

| | | Resistivity | | | | | | | | | | | |
|---|---|---|---|---|---|---|---|---|---|---|---|---|---|
| | Thermal cond, | | Resistivity increment of Al | | Energy release for solidification | | | | Strength | | | | |
| | | | | | Latent | Specific | | Viscosity | Yield | | Tensile | | |
| Element | (W/mK, 25° C.) | Solubility in Al (wt %) | In solution | Out of Solution | Heat (H, kJ/kg) | Heat (c', kJ/kg) | H + c'DT (kJ/kg) | variation of Al | MPa/ at % | MPa/ wt % | MPa/ at % | MPa/ wt % | Phase |
| Cr | 94 | 0.77 | 4.00 | 0.18 | 402 | 0.66 | −0.3 | (+) | | | | | $Al_2Cr$ |
| Cu | 400 | 5.65 | 0.34 | 0.03 | 205 | 0.45 | −2.5 | (+) | 16.2 | 13.8 | 88.3 | 43.1 | $Al_2Cu$ |
| Fe | 80 | 0.05 | 2.56 | 0.058 | 272 | 0.78 | −1.5 | (+) | | | | | $Al_3Fe$ |
| Mg | 160 | 14.9 | 0.54 | 0.22 | 362 | 1.34 | 0.0 | (−) | 17.2 | 16.6 | 51.0 | 50.3 | $Al_3Mg_2$ |
| Mo | 7.8 | 1.82 | 2.54 | 0.34 | 268 | 0.70 | −1.6 | (+) | | 30.3 | | 53.8 | $Al_6Mn$ |
| Ni | 91 | 0.05 | 0.81 | 0.061 | 292 | 0.56 | −1.5 | (+) | | | | | $Al_3Ni$ |
| Si | 150 | 1.65 | 1.02 | 0.088 | 1804 | 0.93 | 14.0 | (−) | 9.3 | 9.2 | 40.0 | 39.6 | Si |
| Zn | 120 | 82.8 | 0.09 | 0.09 | 111 | 0.48 | −3.4 | (0) | 6.6 | 2.9 | 20.7 | 15.2 | — |
| Zr | 23 | 0.28 | 1.74 | 1.74 | 212 | 0.37 | −2.5 | | | | | | $Al_3Zr$ |

A conventional AC2B Al alloy has high thermal conductivity at room temperature (25° C.) and low thermal conductivity at high temperature (200° C.). Whereas, the Al alloy according to the present invention has low thermal conductivity at room temperature (25° C.) and high thermal conductivity at high temperature (200° C.), thus further increasing engine efficiency, ultimately contributing to enhancement in fuel efficiency.

EXAMPLE

As illustrated in FIG. 2, an Al alloy having a composition of Al-1Cu-0.5Fe-2Mg-0.5Mn-0.5Ni-3Si-1Zn-0.3Zr according to the present invention can exhibit low thermal conductivity at room temperature (25° C.) and high thermal conductivity at high temperature (200° C.)

Although the preferred embodiments of the present invention are described with reference to the appended drawings, it will be appreciated that the present invention may be embodied in other specific forms without changing the technical spirit or essential features by one of ordinary skill in the art.

Therefore, the aforementioned embodiments are merely illustrative but are construed as limiting the present invention. The scope of the present invention is represented by the claims below rather than the detailed description, and the meaning and scope of the claims and all modifications or variations derived from equivalents thereof are intended to be incorporated within the scope of the present invention.

What is claimed is:

1. An aluminum alloy, comprising:

1~2 wt % of magnesium (Mg), 1~2 wt % of copper (Cu), 1~2 wt % of zinc (Zn), 0.5~2 wt % of nickel (Ni), about0.5wt % of iron (Fe), about 0.5wt % of manganese (Mn), about 3.0wt % of silicon (Si), about 0.3wt % of zirconium (Zr) and a remainder of aluminum (Al) and inevitable impurities, wherein a thermal conductivity is 185 W/m*k or less at room temperature of about 25° C. and more than 185 W/m*k at high temperature 200° C.

2. The aluminum alloy of claim 1, wherein the aluminum alloy is used for an engine cylinder head.

* * * * *